US009030319B1

(12) United States Patent
Haynes

(10) Patent No.: US 9,030,319 B1
(45) Date of Patent: May 12, 2015

(54) DIGITAL ELECTRONIC SYSTEM FOR AUTOMATIC SHUT OFF AND TURN ON OF ELECTRICAL AND GAS OPERATED APPLIANCES

(76) Inventor: Michael Leroy Haynes, Denver, CO (US)

( * ) Notice: Subject to any disclaimer, the term of this patent is extended or adjusted under 35 U.S.C. 154(b) by 442 days.

(21) Appl. No.: 13/491,097

(22) Filed: Jun. 7, 2012

Related U.S. Application Data

(63) Continuation-in-part of application No. 12/072,506, filed on Feb. 25, 2008, now abandoned.

(60) Provisional application No. 60/903,744, filed on Feb. 26, 2007.

(51) Int. Cl.

| | |
|---|---|
| ***G08B 1/08*** | (2006.01) |
| ***G08B 17/00*** | (2006.01) |
| ***G08B 17/10*** | (2006.01) |
| ***F24C 3/00*** | (2006.01) |
| ***F24C 7/00*** | (2006.01) |

(52) U.S. Cl.
CPC ..... *G08B 17/00* (2013.01); *G08B 17/10* (2013.01); *F24C 3/00* (2013.01); *F24C 7/00* (2013.01)

(58) Field of Classification Search
CPC ..... G08B 17/00; G08B 17/10; G08B 19/00; G08B 19/005; F24C 3/12; F24C 3/122–3/128; F24C 7/08; F24C 7/081–7/088
USPC ..... 340/628–630
See application file for complete search history.

(56) References Cited

U.S. PATENT DOCUMENTS

| | | | | |
|---|---|---|---|---|
| 4,189,720 | A * | 2/1980 | Lott | 340/539.26 |
| 4,496,817 | A * | 1/1985 | Smith | 219/707 |
| 4,612,535 | A * | 9/1986 | Sequin et al. | 340/539.26 |
| 4,984,637 | A * | 1/1991 | Finnigan | 169/61 |
| 5,349,162 | A * | 9/1994 | Holling | 219/445.1 |
| 5,379,453 | A * | 1/1995 | Tigwell | 455/151.2 |
| 5,508,568 | A * | 4/1996 | Mammen | 307/117 |
| 5,697,450 | A * | 12/1997 | Stehling et al. | 169/65 |
| 6,130,412 | A * | 10/2000 | Sizemore | 219/481 |
| 6,529,126 | B1 * | 3/2003 | Henry | 340/467 |
| 7,567,174 | B2 * | 7/2009 | Woodard et al. | 340/539.26 |
| 8,611,062 | B2 * | 12/2013 | Bishop et al. | 361/93.6 |
| 8,807,523 | B2 * | 8/2014 | Pitchford et al. | 251/129.04 |
| 2005/0156730 | A1 * | 7/2005 | Chapman et al. | 340/506 |
| 2006/0044133 | A1 * | 3/2006 | Lou | 340/531 |
| 2008/0018484 | A1 * | 1/2008 | Sager | 340/628 |

FOREIGN PATENT DOCUMENTS

| | | | | |
|---|---|---|---|---|
| GB | 2407719 | A * | 5/2005 | F24C 7/08 |

* cited by examiner

*Primary Examiner* — Steven Lim
*Assistant Examiner* — Ryan Sherwin
(74) *Attorney, Agent, or Firm* — Sheridan Ross P.C.

(57) ABSTRACT

A digital electronic system used for receiving an audio alarm from a smoke detector, a carbon monoxide detector and like detectors. The system amplifies and converts the alarm to a digital encoded radio frequency signal for shutting off power to a kitchen appliance. The system includes a microphone and an amplifier connected to a comparator circuit. This circuit provides for outputting a logic 0 or logic 1 and outputs a logic 1, in the form of the digital radio frequency signal, if an audio alarm is received. The comparator circuit is connected to a transmitter and encoder circuit, which receives the frequency signal and transmits it to a radio frequency receiver and decoder circuit. This circuit then decodes the signal and disconnects the power to the appliance.

20 Claims, 6 Drawing Sheets

DIGITAL ELECTRONIC SYSTEM FOR AUTOMATIC SHUT OFF AND TURN ON OF ELECTRICAL AND GAS OPERATED APPLIANCES

This application is a continuation-in-part patent application based on an earlier filed non-provisional application, having a title "System for Automatic Shut Off of Electrical Circuits, Ser. No. 12/072,506, filed on Feb. 25, 2008 now abandoned, by the subject inventor. Application Ser. No. 12/072,506 claims the benefit of an earlier filed provisional patent application Ser. No. 60/903,744, filed on Feb. 26, 2007, by the subject inventor.

BACKGROUND OF THE INVENTION (a) Field of the Invention

This invention relates to a system used for turning "on" and shutting "off" an electrical circuit to an electrical appliance or a gas appliance. The electrical circuit is adapted for use in a home or an office building and is identified by a brand name "Smart Switch™ System". The subject invention can be used to control specific circuits such as kitchen appliances, space heaters, furnaces, clothes dryers, Christmas tree lights, and other electrically operated or gas operated appliances. The circuit is used to prevent a potential fire or carbon monoxide poisoning. Also, the system can be operated, via the internet, using an internet protocol incorporated into a microprocessor used with the electrical circuit.

More particularly, but not by way of limitation, the electronic system described herein can be used for receiving an audio alarm from a smoke detector, a carbon monoxide detector and similar alarms by amplifying and converting the alarm to a digital encoded signal. The encoded signal can then be transmitted as a digital radio frequency signal used for shutting off electrical power or gas to one or more kitchen appliances and other electrical apparatus.

(b) Discussion of Prior Art

In U.S. Pat. No. 5,508,568 to Mammen, a receptacle safety de-energizer is described. The de-energizer is plugged into a standard electrical power outlet. An electrical plug for a kitchen appliance is connected to the de-energizer. The system includes a power circuit and a protected receptacle connected in series with a building wiring system. The de-energizer doesn't include a digital transmitter or a digital receiver for receiving a digital encoded radio frequency signal. This prior art patent doesn't specifically disclose the unique features and electrical circuitry used in the subject digital electronic system for receiving an audio alarm from a smoke detector as described herein.

SUMMARY OF THE INVENTION

In view of the foregoing, it is a primary objective of the subject invention to provide a digital electronic system that is responsive to an audio alarm from a smoke detector, carbon monoxide detector and similar alarm detectors. The system is used to shut off electric power or gas to one or more kitchen appliances and avoid a potential kitchen fire or fire from other electrical and gas appliances located in a home or office building.

A key object of the subject system is the use of a programmed microprocessor with internet protocol incorporated into the circuitry. This feature allows the user of the system, from a remote location and via the internet, to determine if the electronic system has been activated and therefore response to an alarm.

Another object of the invention is the digital electronic system is readily adaptable for plugging into a standard 110 volt or 220 volt AC outlet used in residential and commercial buildings. Also the system can be used equally well in a hard wire application. Further, the system is adapted for receiving a standard plug or connector used with various kitchen appliance and other electrical and gas operated items.

Yet another object of the invention is the system can be used to control a circuit breaker in a main circuit panel in a home or business. Also, the use of a radio signal, a hard wire signal or an internet protocol signal can be used by the system to allow delivery of information about the circuit panel and where the smoke detector, carbon monoxide detector and other alarms are located and which one has been activated.

A further object of the electronic system is the use of a microphone and transmitter to amplify and convert a smoke detector, a carbon monoxide detector or other audio alarm to a digital encoded radio frequency signal. The digital radio frequency signal is received by a radio frequency receiver and compared, recognized and decoded for turning "off" the electrical power or gas to one or more appliances.

Still further, the electronic system includes a microphone and transmitter that can be conveniently placed at various locations in a building, such as a kitchen, with a smoke detector and a receiver connected to the electrical appliance positioned at a remote location.

The subject invention includes a microphone and an amplifier connected to a comparator circuit. Also, the system includes a programmable microprocessor with internet protocol, a rectifier diode and a surge protector. The comparator circuit provides for outputting a logic "0" or a logic "1". The circuit outputs a logic 1, in the form of a digit radio frequency signal, if the audio alarm from the smoke detector is received. The comparator circuit is connected to a transmitter and encoder circuit. The transmitter and encoder circuit receive a digital radio frequency signal from the comparator circuit and transmits the signal to a radio frequency receiver and decoder circuit. The receiver and the decoder circuit decodes the digital radio frequency signal and disconnects the power to the appliance or circuit breaker.

These and other objects of the present invention will become apparent to those familiar with the systems and electrical circuits used with kitchen appliances and the like when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments in the present invention according to the best modes presently devised for the practical application of the subject digital electronic system, and in which.

DETAILED DESCRIPTION OF THE PREFERRED EMBODIMENTS

Figure 1:
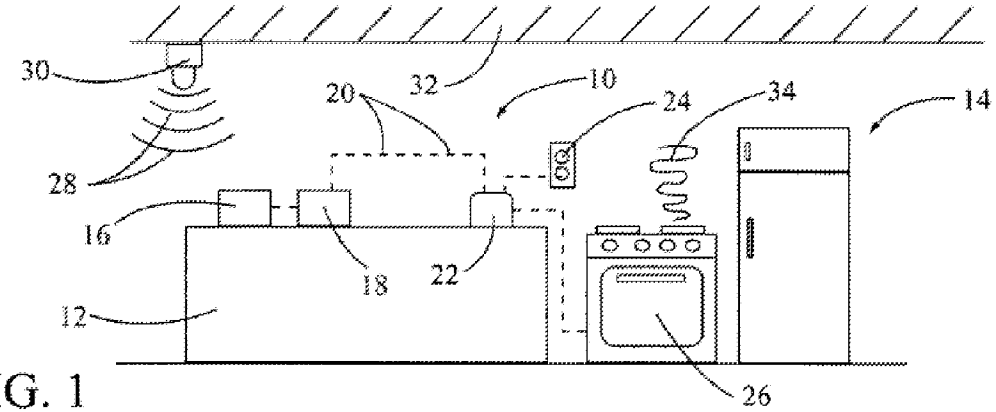
FIG. 1 is a front view of the subject digital electronic system received on a kitchen cabinet and used for use in preventing a potential fire, or carbon monoxide poisoning, or from any other hazardous gas, by shutting off one or more kitchen appliances.

In FIG. 1, a front view of the subject digital electronic system is illustrated and having general reference numeral 10. In this application, the electronic system 10 is shown received on top of a kitchen cabinet 12 in a kitchen 14. The electronic system 10 broadly includes a microphone and amplifier comparator circuit 16 connected to a radio frequency transmitter and encoder circuit 18. The transmitter and encoder circuit 18 is used for outputting a digital radio frequency signal 20, shown in dashed lines, to a receiver and decoder circuit 22. The receiver and decoder circuit 22 is connected to a wall outlet power source 24, next to a kitchen stove 26.

In this drawing, the microphone and amplifier comparator circuit 16 is shown receiving an audio alarm 28 from a smoke detector 30 mounted in a ceiling 32 of the kitchen 14. While the smoke detector 30 is discussed herein, the subject electronic system 10 will work equally well with a carbon monoxide detector and similar alarm devices.

In this example, a stove fire, indicated by smoke 34, has started and the digital electronic system 10 is responding to the audio alarm 28 for shutting off the power to the stove 26. Obviously, the example of a kitchen stove fire 34 is one of any number of examples the subject electronic system 10 can be used in conjunction with the audio alarm 28 from a smoke detector 30 or a carbon monoxide detector and similar detectors. Also, the circuits 16, 18 and 22 can be mounted in different sizes of housings for wall mounting or free standing on a shelf or table. The housings for the circuits are not shown in the drawings. Further, the microphone and amplifier comparator circuit 16 and transmitter and encoder circuit 18 can be placed at various locations and distances apart from the receiver and decoder circuit 22 for transmitting the digital radio frequency signal 20 thereto.

Figure 2:
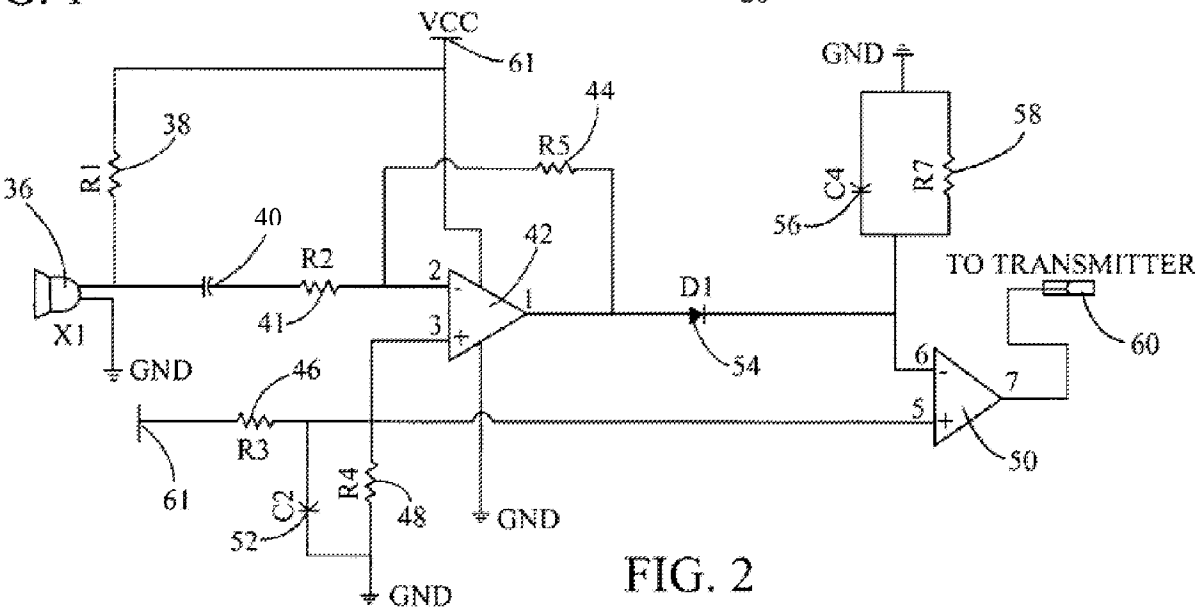
FIG. 2 is a circuit diagram of the microphone and amplifier comparator circuit using a microphone and amplifier used in the subject invention.

In FIG. 2, a circuit diagram of the microphone and amplifier comparator circuit 16 is shown. This circuit is used to pick up the audio alarm 28 from the smoke detector 30 and output a logic 1 (or high) to the transmitter and encoder circuit 18, if the alarm 28 is actuated. Obviously, if no alarm is received, the output from the circuit 16 stays a logic 0 (or low).

The circuit 16 shown in this drawing includes a microphone 36 connected to a resistor 38. The resister 38 is used for biasing the electronic microphone. The microphone 36 is also connected to a first capacitor 40, a resistor 41 and a first amplifier 42 for amplifying a microphone signal from the microphone 36. Resistors 38 and 44 are used to set the gain of the first amplifier 42 to a value of 100. Resistors 46 and 48 set the bias operating point of the first amplifier 42 and a second amplifier 50. A second capacitor 52 provides a high frequency bypass for the bias voltage source between the resistors 46 and 48.

A diode 54 is used to rectify the output of the first amplifier 42 and creates a DC voltage, which is dependent on the amplitude of the audio alarm 28 received by the microphone 36. A third capacitor 56 and resistor 58 provide a filter network that charges upon the receipt of a high amplitude sound wave from the microphone 36. When the voltage of pin 6 on the second amplifier 50 exceeds the bias voltage on pin 5 on the amplifier, the output from the amplifier 50 connected to a transmitter pin 60 goes from a high voltage to a low voltage. This change in voltage provides the output logic 1 to the transmitter and encoder circuit 18 via the transmitter pin 60. The circuit 16 is powered by a low voltage battery power source 61.

Figures 3, 4:
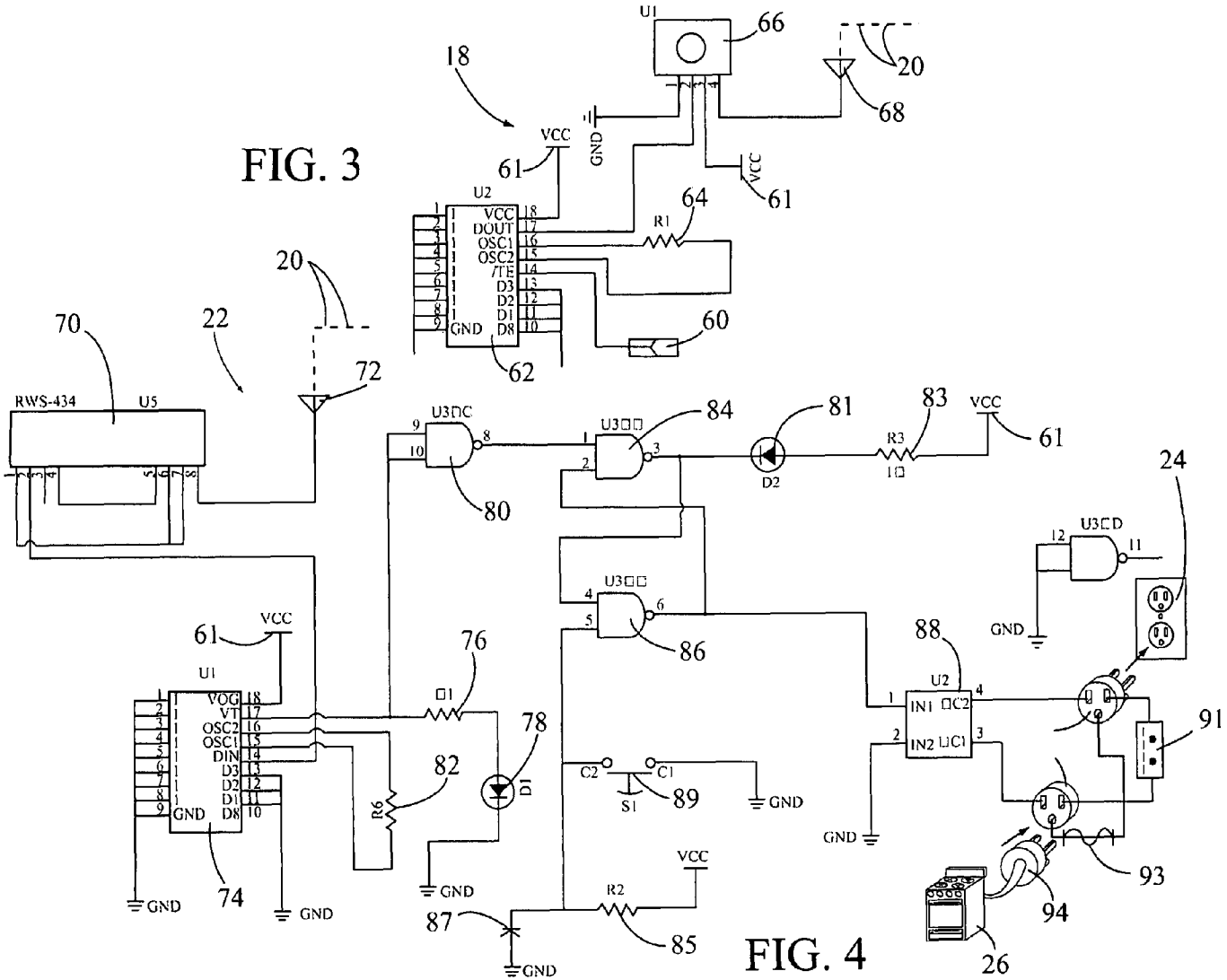
FIG. 3 is a circuit diagram of a radio frequency transmitter and antenna.
FIG. 4 is a circuit diagram of a radio frequency receiver and decoder and connected to a power source and an electric appliance.

In FIG. 3, a circuit diagram of the transmitter and encoder circuit 18 is illustrated. The circuit 18 includes an encoder 62 connected to a resistor 64 and to a transmitter 66. The transmitter 66 includes an antenna 68. When the encoder 62 receives a logic 1 (or high) output signal from the transmitter pin 60, the encoder circuit 18 feeds an encoded data stream to the transmitter 66. In turn, the transmitter 66 transmits the encoded radio frequency signal 20 to the receiver and decoder circuit 22 using the antenna 68. The transmitter 66 operates in a frequency range of 300 to 1500 MHz with AM radio signal modulation. The radio frequency output power into 50 ohms is typically 14 dbm.

In FIG. 4, a circuit diagram of the receiver and decoder circuit 22 is shown. The circuit 22 includes a radio frequency receiver 70 with an antenna 72 for receiving the radio frequency signal 20 from the transmitter 66. The receiver 70 typically operates in a range of 400 to 500 MHz for detecting the AM radio signal modulation. The receiver 70 is connected to a decoder 74 for producing a logic 1 when the radio frequency signal is received. The electrical lead from pin 17 of the decoder 74 is connected to resistor 76. a LED 78 and a logic NAND gate 80. The decoder 74 is also connected to resistor 82.

When the signal 20 is present, the pin 17 goes high and the LED 78 is activated to shown a visual presence of an alarm on the circuit 22. The output of pin 17 goes to the logic NAND gate 80, which converts the signal causing an output pin 8 of the gate 80 to go low. When this happens, a combination of additional logic gates 84 and 86, connected to gate 80, change state and latch. The gate 84 is connected to an LED 81 and a resistor 83. The gate 86 is shown connected to a resistor 85, a capacitor 87, and a reset power switch 89. At this time, the signal to a digital switch 88 turns the electrical power "off" from a first electrical plug 90 connected to the power source 24. The first electrical plug 90 is connected to an appliance AC outlet plug 94 attached to the kitchen stove 26. The two plugs 90 and 92 are wired to a surge protector 91 to prevent any power spikes during the operation of the system 10. Also, the plugs are connected to a rectifier diode 93 for providing a smooth transition of DC power to the AC outlet plug 94.

The power to the kitchen stove 26 or any other electrical or gas operated appliance connected to the plug 92 remains "off" until the reset switch 89 is pressed "on" or the power is removed completely from the circuit 22 and reapplied. When the power is reapplied, the capacitor 87 is discharged and holds a pin 5 on the NAND gate 86 low, thereby resetting the latch combination of the NAND gates 84 and 86. This serves to initialize the circuit 22 when the power is reapplied and returning power for the operation of the kitchen stove 26.

Figure 5:
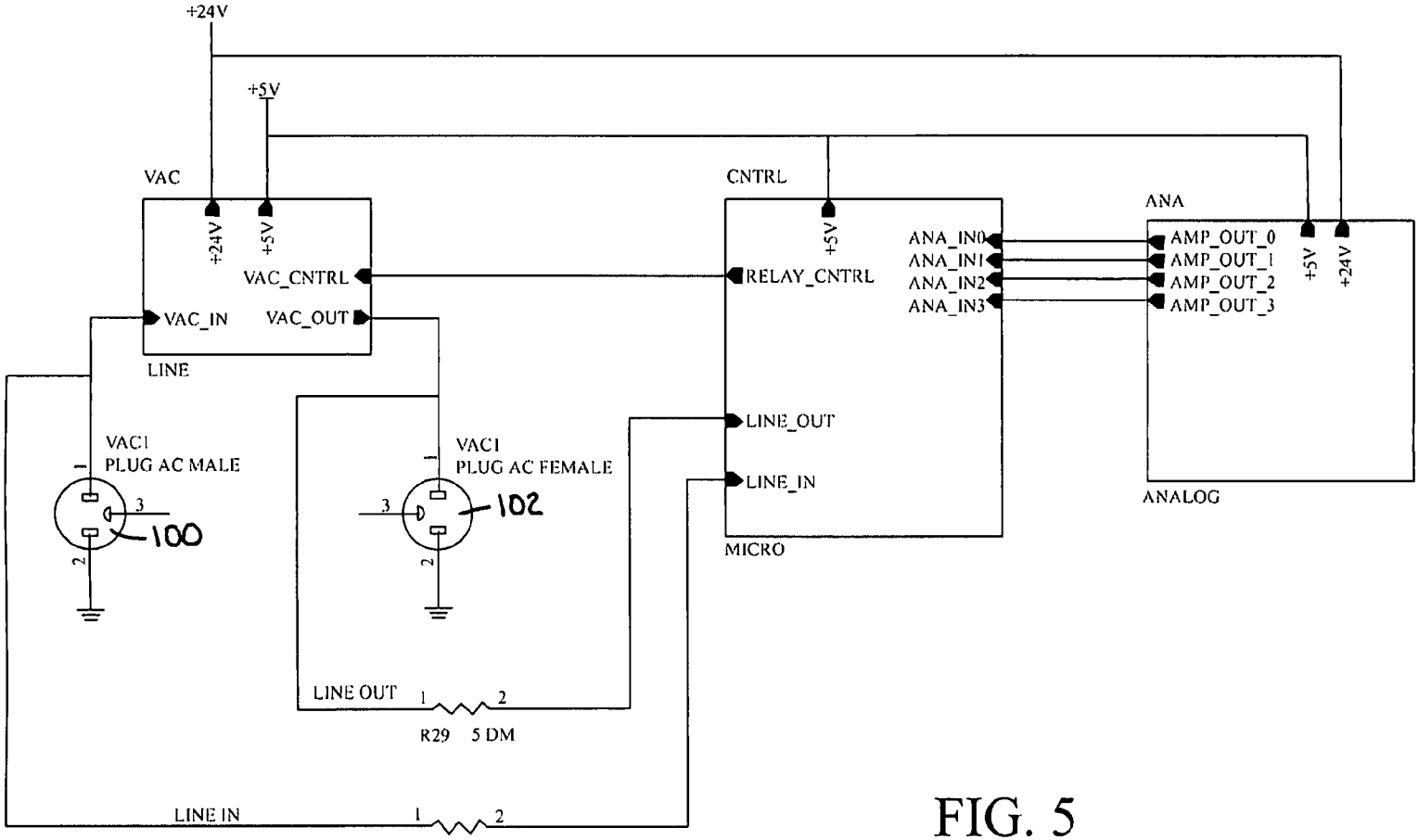
FIG. 5 illustrates another embodiment of the invention's circuitry.
Figure 6:
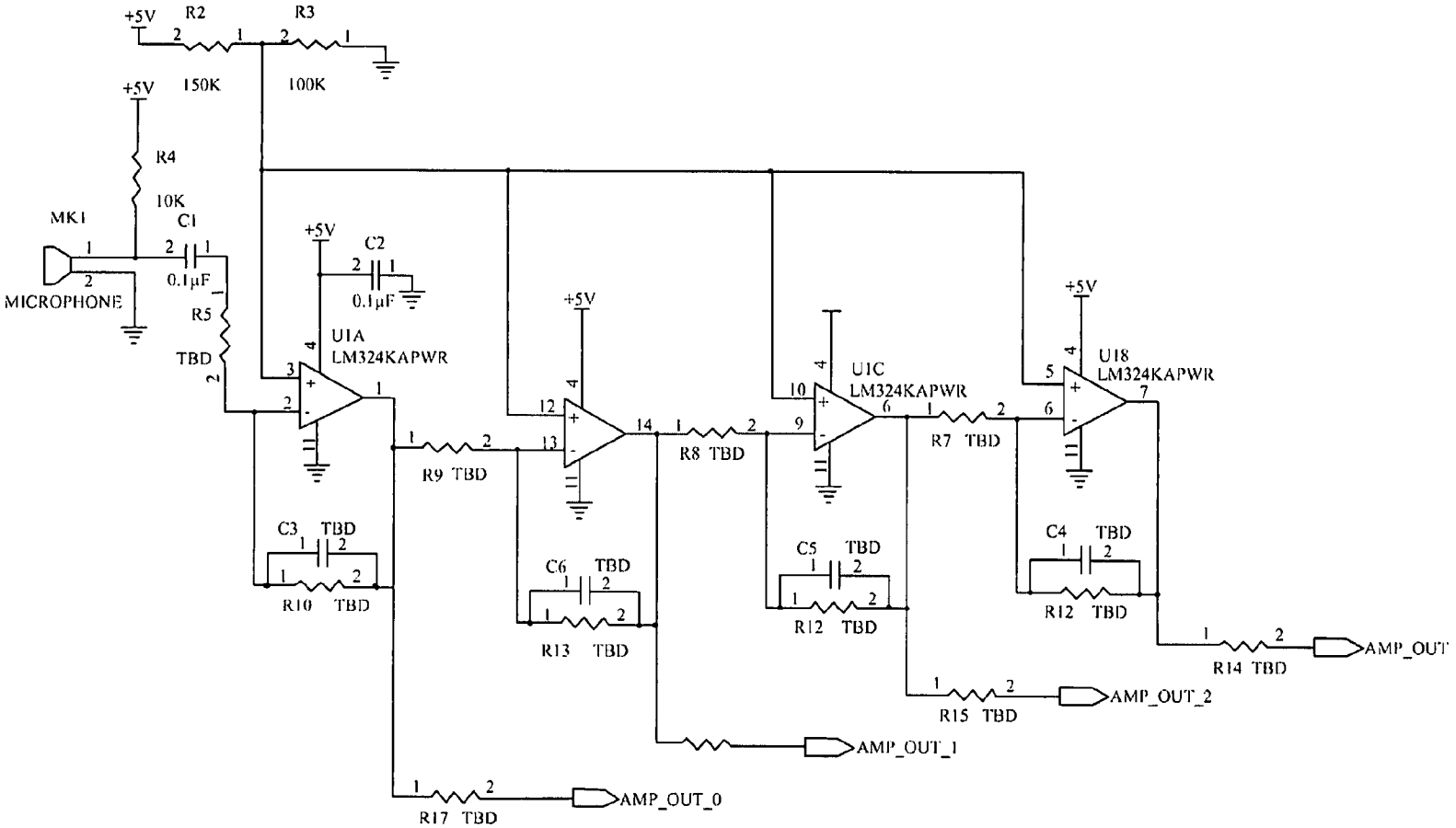
FIG. 6 illustrates another example of a circuit diagram of the microphone and amplifier comparator.
Figure 7:
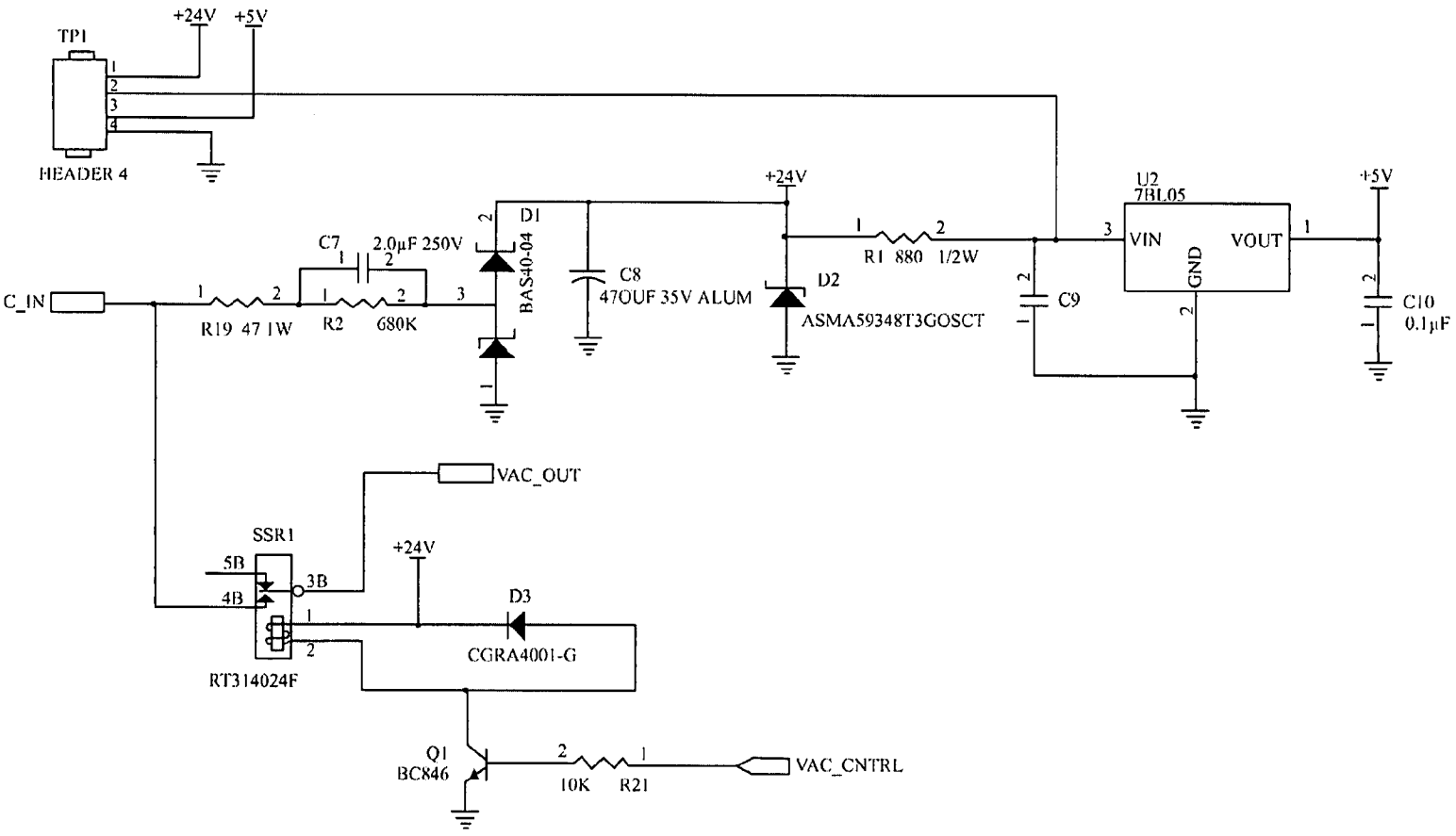
FIG. 7 shows a diagram of a circuit that is used to switch or control another electrical circuit protected by the subject invention.
Figure 8:
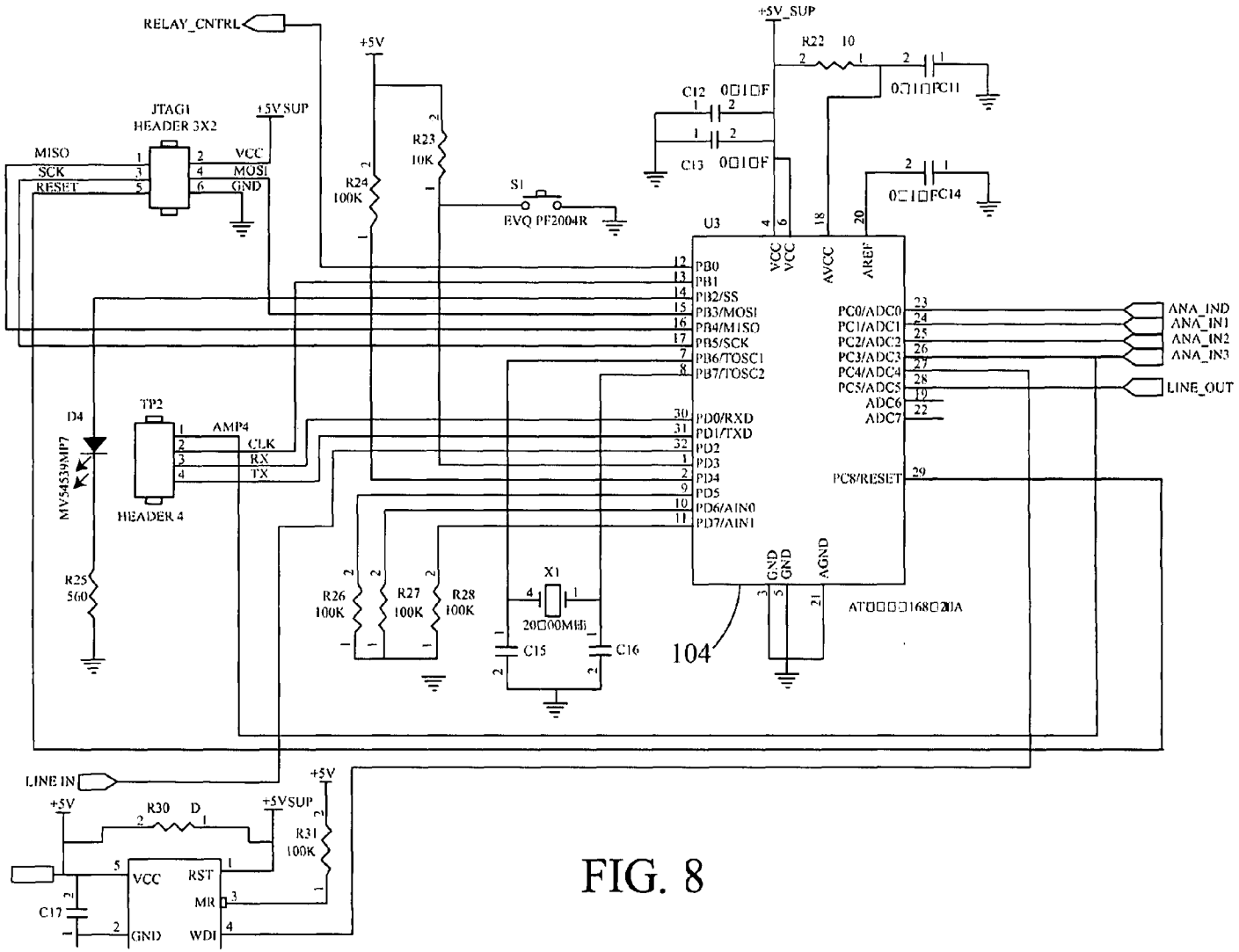
FIG. 8 is a circuit diagram of a programmable microprocessor with internet protocol used to control the system. The internet protocol allows a user of the electronic system to operate the circuitry from a remote location via the internet.

In FIGS. 5-8, another manner of carrying out electrical switching is disclosed and used in conjunction with the switching operation described in FIGS. 1-4. In FIG. 5, the output of the subject electronic system 10 includes an switch input 100 and an output 102. In this example, the input 100 and the output 102 are shown as male and female connectors. However, the connectors can also be used as circuit breakers. Thus, the signal received can be processed and controlled in an entire circuit in a building. Also, it is contemplated that the circuit system can be programmed to discern between a smoke alarm and a loud noise. The loud noise not intended to disconnect or interrupt the flow of current through the system 10. Further, the electronic system 10 can include a programmable microprocessor 104, shown in FIG. 8, programmed to evaluate and recognize not only the specific sound of a fire or other alarm being monitored and evaluate the duration of the alarm. This key function helps prevent the system from shutting off other circuits and appliances in the event of a false alarm. Also another key feature in the subject invention is the incorporation of an internet protocol in the microprocessor. This feature allows the user of the system 10 to operate and control the circuitry discussed above via the internet and respond to an activation of an alarm.

The use of the disclosed switching circuit as breaker switches in a building would allow programming of different circuits in various locations in a building. For instance, in a house or building when medical assistance systems are used, the systems can be programmed to shut off only under very specific conditions, such as where the continued operation of the medical assistance systems may place the occupants in greater danger. Therefore, the microprocessor 104 would not turn off the circuit unless other nearby circuits have been tripped. Also, the microprocessor 104 of an individual circuit can be used to turn on other circuits depending on the conditions detected or associated with other circuits. For instance, if several fire alarms are detected, then outside emergency lighting of a home or building can be turned on, or garage doors can be automatically opened to allow individuals inside the home to escape.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The embodiments of the invention for which as exclusive privilege and property right is claimed are defined as follows:

1. A digital electronic system adapted for receiving an audio alarm from a smoke detector or carbon monoxide detector, the system amplifying and converting the audio alarm to a digital encoded radio frequency signal, the digital radio frequency signal used for shutting off electrical power to one or more electric or gas appliances, the digital electronic system comprising:

a comparator circuit, powered by a low-voltage battery power source, comprising: a microphone, receiving the audio alarm;

a first resistor, directly connected to the microphone and biasing the microphone;

a first amplifier, connected to the microphone and amplifying a microphone signal from the microphone;

a second resistor, acting together with the first resistor to set a gain of the first amplifier to a value of 100 decibels;

a second amplifier, comprising a first pin and a second pin, wherein an output from the second amplifier changes from a high voltage to a low voltage when a voltage on the first pin exceeds a bias voltage on the second pin;

a third resistor and a fourth resistor, together setting a bias operating point of the first amplifier and the second amplifier;

a first capacitor, providing a high-frequency bypass for a bias voltage source between the third resistor and the fourth resistor;

a diode, rectifying an output of the first amplifier and creating a direct current (DC) voltage which is dependent upon an amplitude of the audio alarm received by the microphone;

a filter network, comprising a second capacitor and a fifth resistor and charging upon receiving a high-amplitude sound wave from the microphone; and a transmitter pin, directly connected to the second amplifier, receiving the output from the second amplifier, and producing a comparator output logic 1 when the output from the second amplifier changes from the high voltage to the low voltage.

2. The digital electronic system of claim 1, further comprising a transmitter/encoder circuit, directly connected to the comparator circuit, comprising:

an encoder, sending an encoded data stream when the encoder receives the comparator output logic 1 from the transmitter pin of the comparator circuit; and a transmitter, directly connected to the encoder, comprising a first antenna, transmitting an encoded radio frequency signal via the first antenna when the transmitter receives the encoded data stream from the encoder, and operating with radio signal amplitude modulation, wherein the encoded radio frequency signal has a power ratio of about 14 decibel-milliwatts relative to an impedance of 50 ohms.

3. The digital electronic system of claim 2, further comprising a surge protector, directly connected to an electrical plug, and protecting the system from power spikes.

4. The digital electronic system of claim 2, further comprising a receiver/decoder circuit, comprising:

an electrical plug, directly connected to a wall power outlet source and to an alternating current (AC) outlet plug of the one or more electric or gas appliances, and receiving electrical power from the wall power outlet source;

a radio frequency receiver, comprising a second antenna and receiving the encoded radio frequency signal from the transmitter of the transmitter/encoder circuit via the second antenna;

a decoder, directly connected to the radio frequency receiver and comprising a third pin, wherein the third pin goes high and produces a decoder output when the radio frequency receiver receives the encoded radio frequency a first logic NAND gate, directly connected to the third pin, comprising an output pin, and converting the decoder output, wherein the output pin goes low when the first logic NAND gate converts the decoder output;

a second logic NAND gate, directly connected to the first logic NAND gate and changing state and latching when the output pin of the first logic NAND gate goes low;

a third logic NAND gate, directly connected to the first logic NAND gate, comprising a fourth pin, and changing state and latching when the output pin of the first logic NAND gate goes low;

a digital switch, directly connected to the third logic NAND gate and the electrical plug, and shutting off electrical power to the electrical plug when the third logic NAND gate changes state and latches; and a third capacitor, directly connected to the third logic NAND gate and, when the electrical power to the electrical plug is removed and reapplied, discharging and holding the fourth pin low such that the second logic NAND gate and the third logic NAND Rate unlatch and electrical power to the electrical plug is restored.

5. The digital electronic system of claim 4, wherein the transmitter transmits the encoded radio frequency signal to the radio frequency receiver at a frequency of between about 300 MHZ and about 1200 MHz.

6. The digital electronic system of claim 4, wherein the radio frequency receiver operates at a frequency of between about 400 MHz and about 500 MHz.

7. The digital electronic system of claim 4, wherein the receiver/decoder circuit further comprises a light emitting diode (LED) for visually displaying the audio alarm.

8. A digital electronic system for receiving an audio alarm and shutting off electrical power to one or more electric or gas appliances, comprising:

a comparator circuit, powered by a low-voltage battery power source, comprising:

a microphone, receiving the audio alarm;

a first resistor, directly connected to the microphone and biasing the microphone;

a first amplifier, connected to the microphone and amplifying a microphone signal from the microphone;

a second resistor, acting together with the first resistor to set a gain of the first amplifier to a value of about 100 decibels;

a second amplifier, comprising a first pin and a second pin, wherein an output from the second amplifier changes from a high voltage to a low voltage when a voltage on the first pin exceeds a bias voltage on the second pin;

a third resistor and a fourth resistor, together setting a bias operating point of the first amplifier and the second amplifier;

a first capacitor, providing a high-frequency bypass for a bias voltage source between the third resistor and the fourth resistor;

a diode, rectifying an output of the first amplifier and creating a direct current (DC) voltage which is dependent upon an amplitude of the audio alarm received by the microphone;

a filter network, comprising a second capacitor and a fifth resistor and charging upon receiving a high-amplitude sound wave from the microphone; and a transmitter pin, directly connected to the second amplifier, receiving the output from the second amplifier, and producing a comparator output logic 1 when the output from the second amplifier changes from the high voltage to the low voltage;

a transmitter/encoder circuit, directly connected to the comparator circuit, comprising:

an encoder, sending an encoded data stream when the encoder receives the comparator output logic 1 from the transmitter pin of the comparator circuit; and a transmitter, directly connected to the encoder, comprising a first antenna, transmitting an encoded radio frequency signal via the first antenna when the transmitter receives the encoded data stream from the encoder, and operating with radio signal amplitude modulation, wherein the encoded radio frequency signal has a power ratio of about 14 decibel-milliwatts relative to an impedance of 50 ohms;

an electrical plug, directly connected to a wall power outlet source and to an alternating current (AC) outlet plug of the one or more electric or gas appliances, and receiving electrical power from the wall power outlet source; and a programmable microprocessor, connected to the comparator circuit and comprising an Internet protocol, wherein the Internet protocol enables a user of the system to operate and control the system remotely via the Internet.

9. The digital electronic system of claim 8, wherein the electrical plug is directly connected to a reset power switch.

10. The digital electronic system of claim 9, further comprising a surge protector, directly connected to the electrical plug and protecting the system from power spikes.

11. The digital electronic system of claim 9, further comprising a rectifier diode directly connected to the electrical plug.

12. The digital electronic system of claim 8, wherein the transmitter transmits the encoded radio frequency signal at a frequency of between about 300 MHz and about 1200 MHz.

13. The digital electronic system of claim 8, further comprising a receiver/decoder circuit, comprising:

a radio frequency receiver, comprising a second antenna and receiving the encoded radio frequency signal from the transmitter of the transmitter/encoder circuit via the second antenna;

a decoder, directly connected to the radio frequency receiver and comprising a third pin, wherein the third pin goes high and produces a decoder output when the radio frequency receiver receives the encoded radio frequency signal;

a first logic NAND gate, directly connected to the third pin, comprising an output pin, and converting the decoder output, wherein the output pin goes low when the first logic NAND gate converts the decoder output;

a second logic NAND gate, directly connected to the first logic NAND gate and changing state and latching when the output pin of the first logic NAND gate goes low;

a third logic NAND gate, directly connected to the first logic NAND gate, comprising a fourth pin, and changing state and latching when the output pin of the first logic NAND gate goes low;

a digital switch, directly connected to the third logic NAND gate and the electrical plug, and shutting off electrical power to the electrical plug when the third logic NAND gate changes state and latches; and a third capacitor, directly connected to the third logic NAND gate and, when the electrical power to the electrical plug is removed and reapplied, discharging and holding the fourth pin low such that the second logic NAND gate and the third logic NAND gate unlatch and electrical power to the electrical plug is restored.

14. The digital electronic system of claim 13, wherein the radio frequency receiver operates at a frequency of between about 400 MHz and about 500 MHz.

15. The digital electronic system of claim 13, wherein the receiver/decoder circuit further comprises a light emitting diode (LED) for visually displaying the audio alarm.

16. A digital electronic system adapted for receiving an audio alarm from a smoke detector or carbon monoxide detector and amplifying and converting the audio alarm to a digital encoded radio frequency signal, the digital encoded radio frequency signal used for shutting off electrical power to one or more electric or gas appliances, the digital electronic system comprising:

a comparator circuit, comprising a microphone and at least one amplifier, providing an output logic 0 (or low) under normal operating conditions and providing an output logic 1 (or high) in a form of a digital radio frequency signal when the microphone receives the audio alarm from the smoke detector or carbon monoxide detector;

a low voltage battery source, directly connected to the comparator circuit and providing electrical power thereto;

a transmitter/encoder circuit, directly connected to the comparator circuit, comprising a transmitter and an encoder, and receiving the digital radio frequency signal from the comparator circuit, the encoder encoding the digital radio frequency signal and the transmitter transmitting the encoded digital radio frequency signal at a frequency of between about 300 MHz and about 1200 MHz;

a radio frequency receiver/decoder circuit, comprising a receiver, a decoder, and an electrical plug, the receiver operating at a frequency of between about 400 MHz and about 500 MHz, the decoder decoding the encoded digital radio frequency signal, and the electrical plug directly connected to a wall power outlet source and to an alternating current (AC) outlet plug of the one or more electric or gas appliances and receiving electrical power from the wall power outlet source; and a programmable microprocessor, connected to the comparator circuit and comprising an Internet protocol, wherein the Internet protocol enables a user of the system to operate and control the system remotely via the Internet.

17. The digital electronic system of claim 16, wherein the electrical plug is directly connected to a reset power switch.

18. The digital electronic system of claim 17, further comprising a surge protector, directly connected to the electrical plug and protecting the system from power spikes.

19. The digital electronic system of claim 17, further comprising a rectifier diode directly connected to the electrical plug.

20. The digital electronic system of claim 16, wherein the radio frequency receiver/decoder circuit further comprises a light emitting diode (LED) for visually displaying an audio alarm.

* * * * *